US005319359A

United States Patent [19]

Zampini et al.

[11] Patent Number: 5,319,359

[45] Date of Patent: Jun. 7, 1994

[54] CROSS FADE INDICATORS

[75] Inventors: Michael A. Zampini, Boca Raton; Alan Flum, Tamarac, both of Fla.

[73] Assignee: Sony Electronics Inc., Park Ridge, N.J.

[21] Appl. No.: 866,356

[22] Filed: Apr. 10, 1992

[51] Int. Cl.[5] ..... G08B 5/22

[52] U.S. Cl. ..... 340/815.45; 381/56; 84/464 R

[58] Field of Search ..... 340/815.06; 381/56, 381/58, 119; 84/470, 464 R

[56] References Cited

U.S. PATENT DOCUMENTS

| | | | |
|---|---|---|---|
| 3,873,979 | 3/1975 | Craford et al. . | |
| 3,909,770 | 9/1975 | Oka et al. | 350/815.06 |
| 4,041,401 | 8/1977 | Kitamura et al. | 340/815.06 |
| 4,214,200 | 7/1980 | Hollander . | |
| 4,300,225 | 11/1981 | Lambl | 84/464 R |
| 4,386,551 | 6/1983 | Morgando | 84/470 R |
| 4,388,589 | 6/1983 | Molldrem, Jr. . | |
| 4,581,758 | 4/1986 | Coker et al. | 381/56 |
| 4,677,674 | 6/1987 | Snyder | 381/58 |
| 4,806,931 | 2/1989 | Nelson | 381/56 |
| 4,812,744 | 3/1989 | Havel . | |
| 5,003,247 | 3/1991 | Havel . | |

*Primary Examiner*—Ulysses Weldon
*Assistant Examiner*—Gin Goon
*Attorney, Agent, or Firm*—Ronald P. Kananen

[57] ABSTRACT

A dual colored LED indicator is provided for each channel of an audio mixing console to enable an operator to determine the status of at least a first and second device. Preferably, a red indication from the LED indicates a device is active and a green indication from the LED indicates that a device is set to become active or has just become inactive. The invention enables an operator to determine which device is set to next become active in a cross fade operation.

18 Claims, 3 Drawing Sheets

CROSS FADE INDICATORS

FIELD OF THE INVENTION

The invention relates generally to audio for video mixing consoles having a plurality of channels and more specifically to indicators for indicating the status of the plurality of channels.

BACKGROUND OF THE INVENTION

In the use of audio for video mixing consoles, its is common to mix signals from various channels. With multi-channel devices, for example 24 or 48 channels, it is important to ascertain that the correct channels have been selected to implement the desired mix. Typically, a video editor may be used to implement a mix, in a manner well known in the art. Alternatively, automatic or manual mixing may be implemented.

Under a common set of circumstances, the mixing console may be connected to one or more VIDEO TAPE RECORDERS (VTRs) or other devices. Typically, the VTR may comprise some two-channel VTRs and some four-channel VTRs. Depending on the configuration of two and four-channel VTRs, different channels of the mixing console will be associated with different devices. It is often desired to cross fade different channels of these devices.

Prior art consoles enable various channels to be cross faded. However, the prior art fails to disclose enabling a user to ascertain which channels of the mixing console are currently active and which will be cross faded prior to implementation of the cross fade in the manner suggested by the present invention.

According to the invention, each channel of an audio mixing console is provided with a dual colored LED to visually indicate which channel(s) of the mixer is active and which is set to be cross faded. According to another aspect of the invention, a mode switch is provided to enable the user to make a quick verification of what is about to happen before a mix is actually implemented.

BRIEF DESCRIPTION OF THE DRAWINGS

FIG. 3 and 3*a*–3*d* are timing diagrams illustrating the operation of an embodiment of the present invention.

DETAILED DESCRIPTION OF THE PREFERRED EMBODIMENTS

With reference to the accompanying figures, a detailed description of the preferred embodiments will be provided.

Figure 1:
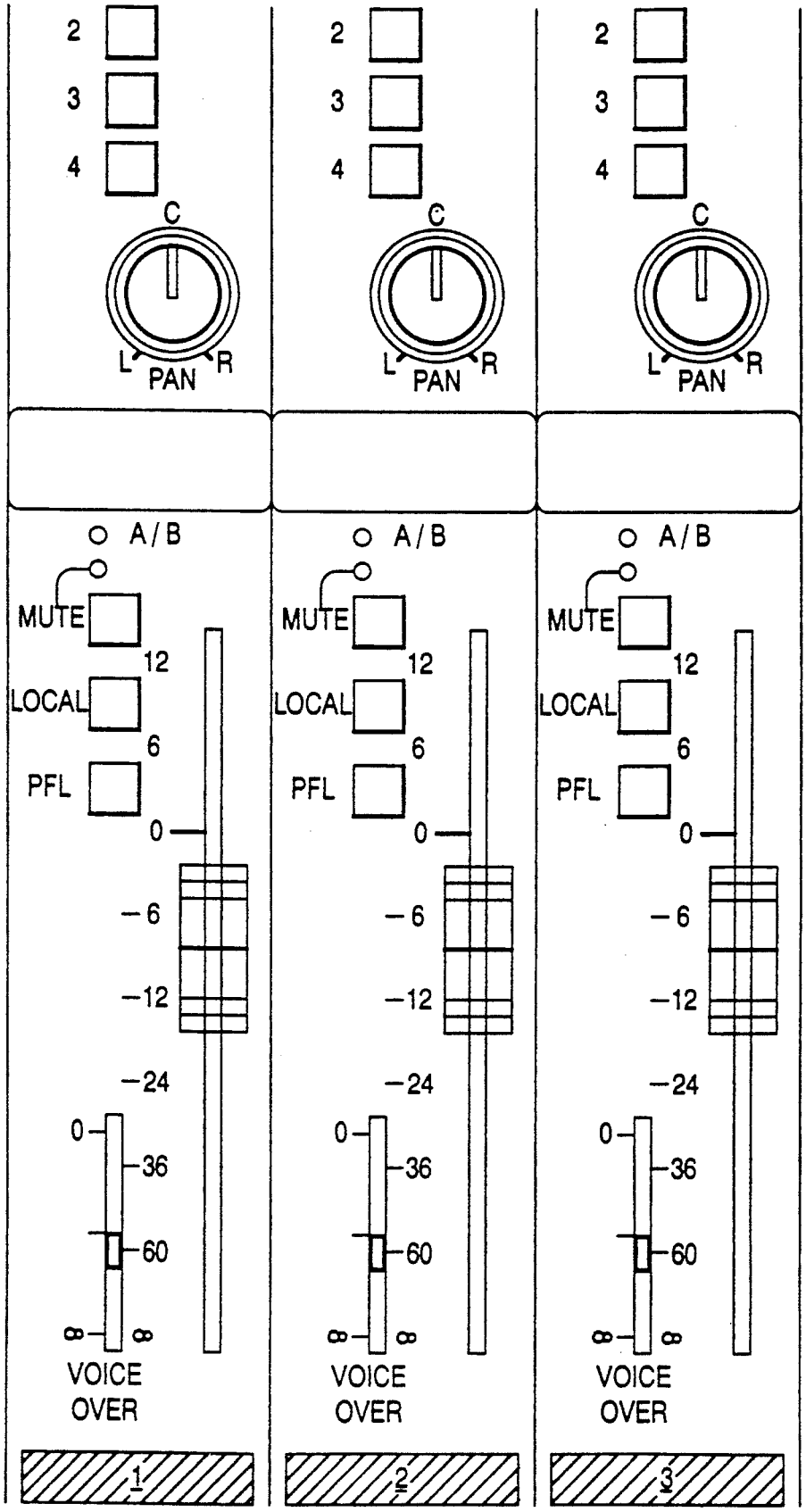
FIG. 1 is a schematic illustration of a portion of a mixing console incorporating features of the present invention.

The invention relates generally to an improvement in audio mixing consoles. Audio mixing consoles, per se, are known to those of ordinary skill in the art. As shown in FIG. 1, according to the present invention, the audio mixing console comprises an indicator, for example a dual colored LED, for each channel of the console, such as LED 22 and channel 1. For purposes of example only, it will be assumed that a dual colored LED is used and that the dual colored LED is capable of generating a red light, a green light or no light. According to the preferred embodiment, although the invention is not so limited, the red light may indicate a device which is currently active and a green light may indicate a device which is either about to become active or which has just been deactivated. The LED associated with other channels may have no output if, for example, that channel is not involved in a current mix or cross fade.

Figure 2:
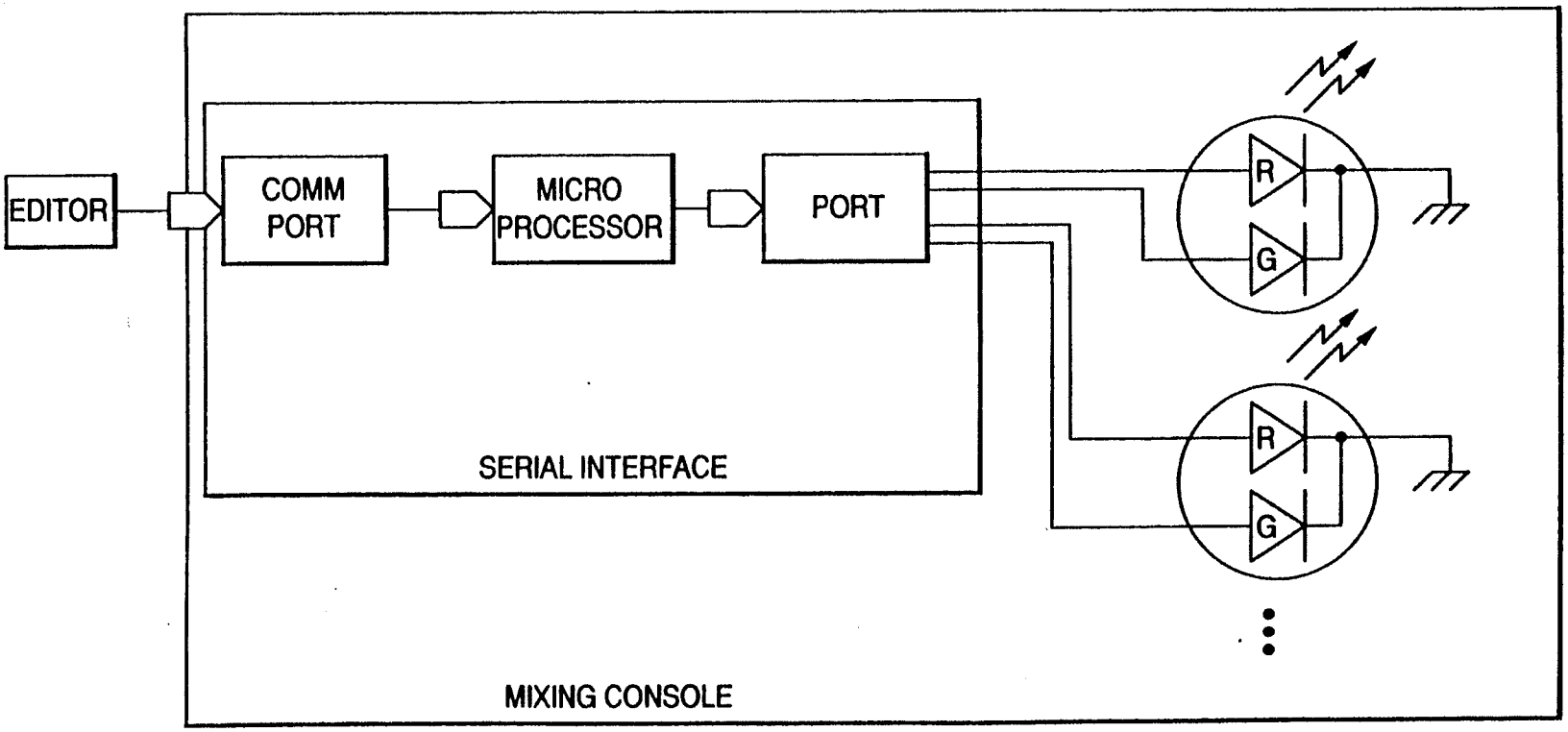
FIG. 2 is a schematic block diagram illustrating various features of the present invention.

One embodiment for implementing the aforementioned features is shown in FIG. 2. With reference to FIG. 2, there is shown an editor 10. However, it is to be understood that the features of the invention are equally applicable with respect to other types of control of a mix or cross fade operation. The editor 10 shown in FIG. 2 issues signals to a serial interface 30 which may include, for example, a communication port 32, microprocessor 34 and an output port 36. The serial interface 30 may be located within the mixing console 20. The output of the port 36 which receives signals from the microprocessor 34 is connected to the dual colored LEDs 22 and 24, two of which are shown, but as indicated in FIG. 2, others are intended. In order to understand the timing of the activation of the red R or green G LED portions of the dual colored LEDs 22 and 24, the timing diagrams of FIG. 3 are believed to be particularly helpful.

Figure 3:
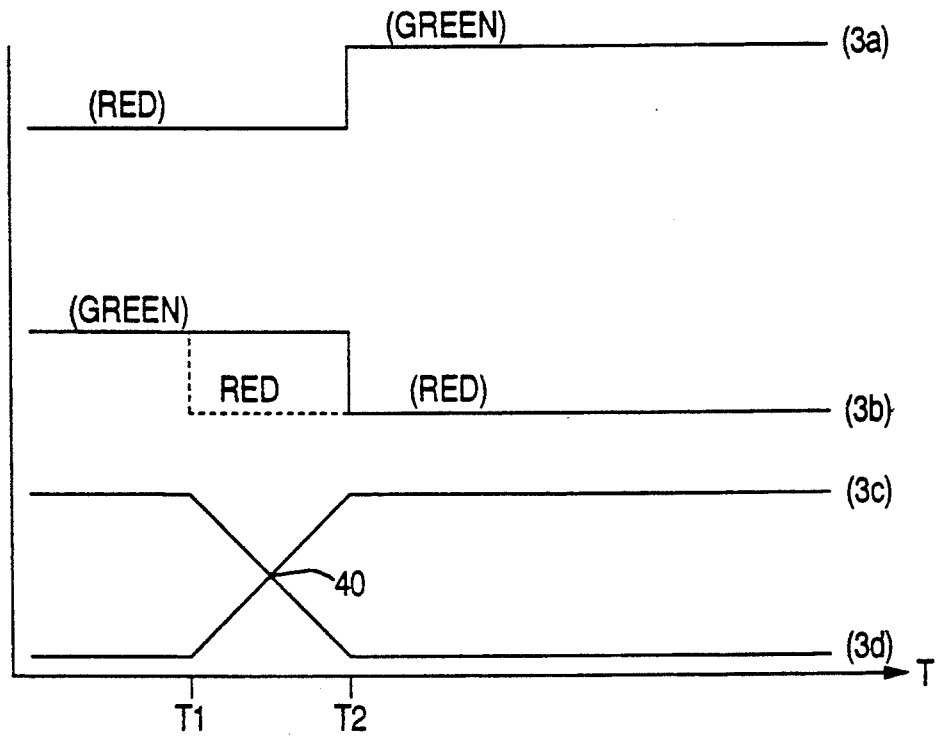

With reference to FIG. 3, for example, there is shown a timing diagram which illustrates a principle of the present invention. Curve 3*a* of FIG. 3 depicts that status of the dual colored LED associated with a first channel 1 having, for example, LED 22. The LED 22 associated with this first channel 1 is shown to be red up until time T2, at which time the LED 22 changes its state to green. This indicates, for example, to an operator that up until time T2 the first channel 1 is active, and at time T2 the first channel has become inactive.

Conversely, as shown in curve 3*b*, the LED associated with a second channel 2 having, for example, LED 24, indicates that the second channel 2 is inactive until time T2, as indicated by the green output of the LED 24, and at time T2 it becomes active as indicated by the red output of the LED 24 associated with the second channel 2.

As shown in curves 3*c* and 3*d*, a representative output of the first 1 and second 2 channels, respectively, for a given time period, is shown. Time T1 may correspond to a time at which an edit command is issued by the editor 10 of FIG. 2, in a manner well known in the art. This command may cause the output of the first channel 1 to be faded down and the output of the second channel 2 to be faded up. This fade down and fade up, respectively, takes a finite period of time as indicated by the time between T1 and T2. At time T2, the fade up and fade down have been completed and the first channel 1 has become inactive, while the second channel 2 has become active. This corresponds to the green output for the LED 22 associated with the first channel 1 and the red output for the LED 24 associated with the second channel 2, as shown in curves 3*a* and 3*b*, respectively. Although the changes from green to red and from red to green are illustrated as occurring at time T2, the color changes may instead occur at any of the times between times T1 and T2.

Thus, as shown by the solid lines, the red status of the first channel remains red until the cross-fade is completed at T2, while the green status of the second channel being faded in, or made active, remains green until T2 when it turns red. These states indicate to the operator which channel is active, and which channel is about to become active at T2. As shown by the dotted lines, the second channel to be faded in can be indicated as red at T1, so that during the fade from T1 to T2, both channels are indicated with a red color indication. This indicates to the operator that both channels are active during the fade interval T2−T1, the first fading out while the second is fading in. As indicated above, the color change could also occur during the crossover time T1 to T2, such as at the point of crossover 40.

One advantage of this invention is that it enables an operator to easily monitor which device is currently active and which device is set to be next brought into operation.

Advantageously, the operator can determine this information prior to executing an edit operation. This avoids erroneous edits which saves time and money. Additionally, these advantages may be achieved without adding an additional light to the console, for example, if an indicator is already used to indicate if a channel is active. This is particularly advantageous where console space is at a premium, as it usually is.

Some mixing consoles are able to operate in at least a MANUAL mode, an AUTOMATIC mode and an EDITOR mode. According to one possible arrangement, when the console is powered on the initial mode will be the EDITOR mode. The operator then presses a mode select button (located on the console) until the MANUAL mode is entered.

To operate in the MANUAL mode the user will simply select the correct VTR configuration for the desired setup. Once the configuration is selected, the user may verify the setup by pressing one of the machine selection switches which may be located on the console and watching the appropriate dual colored LEDs on the console move. A dual colored LED is conveniently located next to each channel fader as shown in FIG. 1, for example.

The next step to operate the MANUAL mode is to check where the manual fader is located. If it is at the A side of its travel then the first cross fade will be performed from A to B. If the location is at the B side of its travel then the first cross fade will be from B to A. Next to each machine selection switch there is an LED that indicates the current FROM machine.

The user now will select the correct FROM and TO machines on the associated thumb wheel switches. The dual colored LEDs indicate the FROM and TO I/O channels. The red LEDs indicate the FROM I/O channels and under normal operation should not be changed, unless the user desires the current machine to be CUT. The green LEDs indicate the TO I/O channels. This is the machine that will, under normal operation, be changed. The user must be careful when changing machines that they are moving the TO machine. There is an LED indicator next to the current FROM machine selection switch.

Once the user has selected the correct TO and FROM machines he may simply move the manual fader and the console will follow these movements. If desired, once the cross fade has reached a certain point both the LEDs associated with the FROM machine and the TO machines will be indicated in red. This indicates to the user from where the audio is coming. When the user reaches the other side of the manual fader travel they will note that the FROM and TO machines have reversed. This will allow the user to perform multiple cross fades without having to change the FROM and TO machines. Under MANUAL mode operation, the mixer can accept monitor switching commands from the video editor 10. This will allow the operator to perform normal "PREVIEW" and "REVIEW" audio monitoring while performing manual transitions.

Another mode of operation is the auto-transition mode, or simply, the AUTO mode. The AUTO mode automates many of the features described in the MANUAL mode. In the AUTO mode the FROM and TO machines are selected. If the user has just performed a cross fade with the manual fader this may be done based on the last position of the manual fader and the FROM and TO machines from the previous manual edit. If a manual fade has not been performed the user may select the FROM machine and the TO machines as described above.

Once the user has entered AUTO mode and the machines are selected the indicators will indicate which FROM and TO machine are selected. The red LEDs indicate the current FROM machines and channels. The green LEDs indicate the TO machine channels.

To select a different FROM machine the user simply presses the thumb wheel switch near the LED that is illuminated. When this is completed the TO machine may be selected. The LEDs associated with the channels of the selected machines indicate what is about to happen.

To begin the cross fade the user simply presses a start button, or the interface may receive a command from the General Purpose Interface (GPI). As soon as the transition has started the green LED next to the TRANSITION START button will illuminate. When the transition is complete the green LED will be turned off and the FROM and TO machines will be swapped so the user can perform multiple cross fades without making any changes on the top panel. Under AUTO mode operation, the mixer can accept monitor switching commands from the video editor 10. This will allow the operator to perform normal "PREVIEW" and "REVIEW" audio monitoring while performing auto transitions.

While the invention has been described in connection with a dual colored LED associated with each channel, a variety of other indicator devices could be used instead. Preferably, the indicator used is capable of taking on at least a first state or second state and may also be capable of taking on an off state separate from the first and second states. Alternatively, two separate indicators could be used. However, where console space is of a concern, a single dual state indicator is generally preferable.

Various other modifications and alternatives will be readily apparent to one of ordinary skill in the art. The invention is not limited to the preferred embodiments described herein. Rather, the invention is only limited by the claims appended hereto.

I claim:

1. A multi-channel mixing apparatus capable of mixing signals from at least two channels and visually indicating the status of the channels, comprising:

a mixer;

at least two channels to be mixed by said mixer, said two channels being at least a first channel and a second channel;

a first and a second dual colored LED respectively associated with each of said first and second channels for indicating which of said first and said second channels to the mixing apparatus are active, wherein one color of said dual colored LED indicates its associated channel is currently active and the other color of the dual colored LED indicates its associated channel that is about to become active; and means cooperating with said mixer for controlling said first and said second LEDs during mixing so that said first LED shows a first color when said first channel is active and a second color when said first channel is inactive, and said second LED shows a second color when said second channel is inactive and a first color when said second channel is about to become active or when fully active during a mixing transition between said first and said second channels.

2. The apparatus of claim 1 further comprising:

mode switch means for switching the mixing apparatus from a normal mode to a visual indication mode in which said dual colored LEDS indicate which channels o the mixing apparatus are set to be mixed.

3. The apparatus as set forth in claim 2 wherein said dual colored LED includes a first color and a second color wherein said first color is red indicating a channel is active and said second color is green indicating that said channel is about to become active.

4. The apparatus as set forth in claim 2 wherein each of said first and said second dual colored LEDs has an off state to indicate that said first and said second channels are neither active nor set to become active in said mixer.

5. The apparatus as set forth in claim 1 further including an editor in communication with said mixer through a communication port and a microprocessor.

6. The apparatus as set forth in claim 1 wherein said mixing transition is a fade interval T2−T1, where T1 is the beginning of the fade where the first channel is active and the second channel is inactive but about to become active, and where T2 is the end of the fade where the first channel has become inactive and the second channel has become active, wherein said first and said second dual colored LEDs shows a first color during at least a portion of said fade interval.

7. The apparatus as set forth in claim 6 wherein both of said first and said second dual colored LEDs shows that said first and second channels are active during the entire portion of the fade interval T2−T1.

8. The apparatus as set forth in claim 1 wherein said mixer is operable according to signals provided from an editor.

9. A multi-channel audio mixing apparatus comprising:

selection means for selecting at least a first channel which is an active channel and for selecting at least a second channel which is about to become active;

a mixer having a fader means for mixing signals from said first channel and said second channel by fading down signals from said first active channel and fading up signals from a second channel which is about to become active during a fade interval T2−T1, where T1 is the beginning of the fade where the first channel is active and the second channel is inactive but about to become active, and where T2 is the end of the fade where the first channel has become inactive and the second channel has become active;

a first indicator associated with said first channel for indicating that the first channel is active at T1 and continues to indicate that said first channel is active until T2; and a second indicator associated with said second channel for indicating that the second channel is about to become active at T1, whereupon both of said first and said second indicators indicate that said first and second channels are active during at least a portion of the fade interval T2−T1.

10. The apparatus as set forth in claim 9 wherein both of said first and said second indicators indicate that said first and second channels are active during the entire portion of the fade interval T2−T1.

11. The apparatus as set forth in claim 9 wherein each of said first and said second indicators has a first state of illumination and a second state of illumination respectively indicating that the associated channel is respectively active and about to become active.

12. The apparatus as set forth in claim 11 wherein said first state and said second state of illumination of said first and said second indicators are respectively a first color and a second different color.

13. The apparatus as set forth in claim 12 wherein said first color is red indicating a channel is active and said second color is green indicating that said channel is about to become active.

14. The apparatus as set forth in claim 13 further indicating an editor in communication with said mixer through a communication port and a microprocessor.

15. The apparatus as set forth in claim 12 further including an editor in communication with said mixer through a communication port and a microprocessor.

16. The apparatus as set forth in claim 11 wherein each of said first and said second indicators has an off state to indicate that said first and said second channels are neither active nor about to become active in said mixer.

17. The apparatus as set forth in claim 11 further including an editor in communication with said mixer through a communication port and a microprocessor, for selecting said second channel as an about-to-become-active channel.

18. The apparatus as set forth in claim 9 wherein said mixer is operable according to signals provided from an editor.

* * * * *